US005373595A

United States Patent [19]

Johnson et al.

[11] Patent Number: 5,373,595

[45] Date of Patent: Dec. 20, 1994

[54] AIR SUPPORT DEVICE

[75] Inventors: Peter D. Johnson; Stephen J. Matheson; James V. Hogan; David B. Webb, all of Fort Erie; John M. Rossiter, Stevensville, all of Canada

[73] Assignees: Irvin Industries Canada Ltd., Fort Erie; Namtec Corporation, London, both of Canada

[21] Appl. No.: 30,656

[22] Filed: Mar. 12, 1993

[51] Int. Cl.[5] ..... A61G 7/04; A47C 27/08

[52] U.S. Cl. ..... 5/453; 5/455; 5/470; 5/914; 285/361

[58] Field of Search ..... 5/449, 453, 455, 469, 5/470, 914; 285/360, 361, 204, 205, 209

[56] References Cited

U.S. PATENT DOCUMENTS

| | | | |
|---|---|---|---|
| 1,772,310 | 8/1930 | Hart | 5/453 X |
| 2,604,641 | 7/1952 | Reed | 5/455 |
| 2,719,986 | 10/1955 | Rand | 5/453 |
| 2,823,394 | 2/1958 | Smith | 5/348 |
| 3,605,138 | 9/1971 | Tucker | 5/90 |
| 3,644,950 | 2/1972 | Lindsay, Jr. | 5/469 X |
| 3,667,073 | 6/1972 | Renfroe | 5/469 X |
| 3,705,429 | 12/1972 | Nail | 5/349 |
| 3,740,777 | 6/1973 | Dee | 5/469 X |
| 3,822,425 | 7/1974 | Scales | 5/348 R |
| 3,909,858 | 10/1975 | Ducker | 5/348 R |
| 3,949,438 | 4/1976 | Scales | 5/348 R |
| 4,099,276 | 7/1978 | Hunt et al. | 5/72 |
| 4,224,706 | 9/1980 | Young et al. | 5/449 |
| 4,424,600 | 1/1984 | Callaway | 5/470 |
| 4,481,686 | 11/1984 | Lacoste | 5/453 |
| 4,488,322 | 12/1984 | Hunt et al. | 5/453 |
| 4,525,885 | 7/1985 | Hunt et al. | 5/453 |
| 4,542,547 | 9/1985 | Sato | 5/453 |
| 4,622,706 | 11/1986 | Takeuchi | 5/453 |
| 4,638,519 | 1/1987 | Hess | 5/455 |
| 4,646,373 | 3/1987 | Guldager | 5/455 |
| 4,686,722 | 8/1987 | Swart | 5/453 |
| 4,694,520 | 9/1987 | Paul | 5/453 |
| 4,706,313 | 11/1987 | Murphy | 5/464 |
| 4,722,105 | 2/1988 | Douglas | 5/453 |
| 4,745,647 | 5/1988 | Goodwin | 5/453 |
| 4,768,249 | 9/1988 | Goodwin | 5/453 |
| 4,797,962 | 1/1989 | Goode | 5/453 |
| 4,798,227 | 1/1989 | Goodwin | 137/554 |
| 4,896,389 | 1/1990 | Chamberland | 5/453 |
| 4,897,890 | 2/1990 | Walker et al. | 5/453 |
| 4,907,308 | 3/1990 | Leininger | 5/455 |
| 4,914,771 | 4/1990 | Afeyan | 5/453 |
| 4,944,060 | 7/1990 | Peery et al. | 5/453 |
| 4,949,412 | 8/1990 | Goode | 5/453 |
| 4,949,413 | 8/1990 | Goodwin | 5/453 |
| 4,949,414 | 8/1990 | Thomas et al. | 5/453 |
| 4,951,335 | 8/1990 | Eady | 5/450 |
| 4,953,247 | 9/1990 | Hasty | 5/453 |
| 4,962,552 | 10/1990 | Hasty | 5/453 |
| 4,982,466 | 1/1991 | Higgins et al. | 5/453 |
| 4,989,283 | 2/1991 | Krouskop | 5/453 |
| 4,999,074 | 3/1991 | Afeyan | 156/204 |
| 5,003,654 | 4/1991 | Vrzalik | 5/453 |
| 5,005,240 | 4/1991 | Vrzalik | 5/453 |
| 5,010,608 | 4/1991 | Barnett et al. | 5/453 |
| 5,044,029 | 9/1991 | Vrzalik | 5/453 |
| 5,051,673 | 9/1991 | Goodwin | 318/481 |
| 5,062,171 | 11/1991 | Vrzalik | 5/455 |
| 5,065,466 | 11/1991 | Thomas et al. | 5/453 |
| 5,090,074 | 2/1992 | Scales et al. | 5/448 |
| 5,090,077 | 2/1992 | Caden et al. | 5/456 |
| 5,095,568 | 3/1992 | Thomas et al. | 5/453 |
| 5,103,519 | 4/1992 | Hasty | 5/453 |
| 5,142,719 | 9/1992 | Vrzalik | 5/609 |
| 5,152,021 | 10/1992 | Vrzalik | 5/455 |
| 5,168,589 | 12/1992 | Stroh, Jr. | 5/453 X |
| 5,267,364 | 12/1993 | Volk | 5/453 |
| 5,272,778 | 12/1993 | Gore | 5/453 |

FOREIGN PATENT DOCUMENTS

| | | |
|---|---|---|
| 0034954 | 9/1981 | European Pat. Off. . |
| 0260087 | 3/1988 | European Pat. Off. . |
| 1273342 | 5/1972 | United Kingdom . |
| 2141333A | 12/1984 | United Kingdom . |
| 2177595A | 1/1987 | United Kingdom . |
| 8801860 | 12/1988 | WIPO . |
| 8801861 | 12/1988 | WIPO . |

*Primary Examiner*—Michael F. Trettel
*Attorney, Agent, or Firm*—Crossetta & Associates

[57] ABSTRACT

This invention relates to a portable air support device having a plurality of air inflatable cells, arranged within a conveniently dissembled air support bag. The portable device comprises a novel air distribution manifold, control console and air distribution valve assembly to inflate a novel air flow quilt which provides an upward flow of air to a patient reclining thereon, to provide comfort and promote patient healing.

51 Claims, 6 Drawing Sheets

Fig. 10.
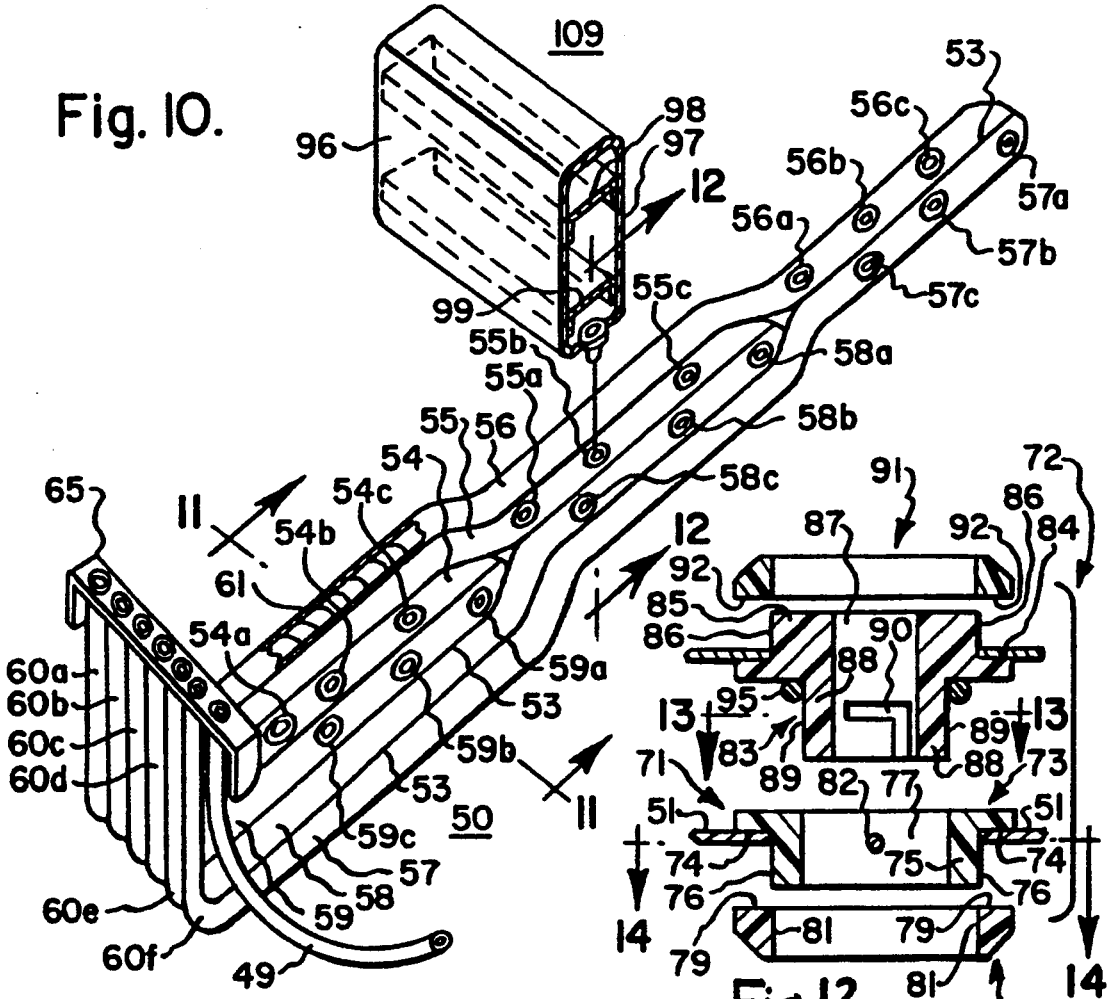
Fig. 12.
Fig. 13.
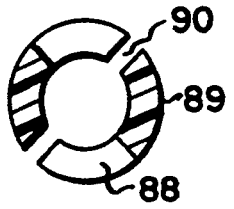
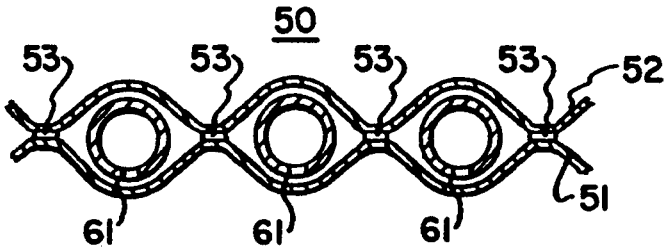
Fig. 11.
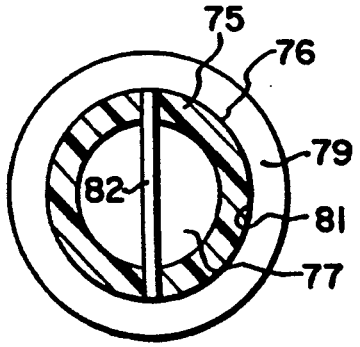
Fig. 14.

Fig. 16.
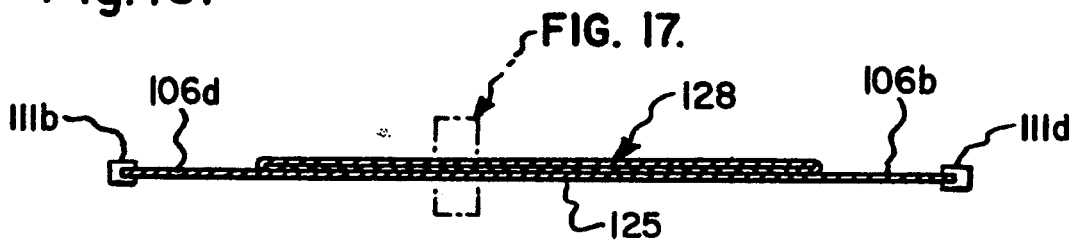
Fig. 17.
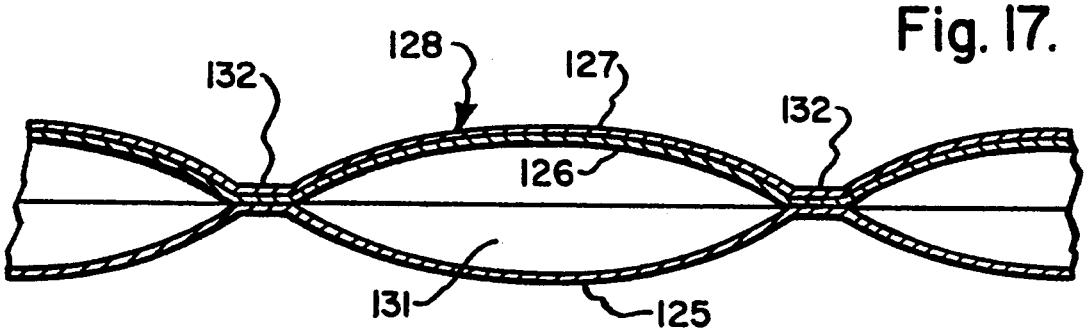
Fig. 18.
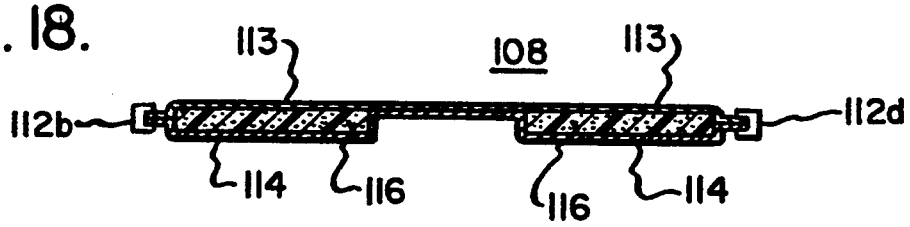
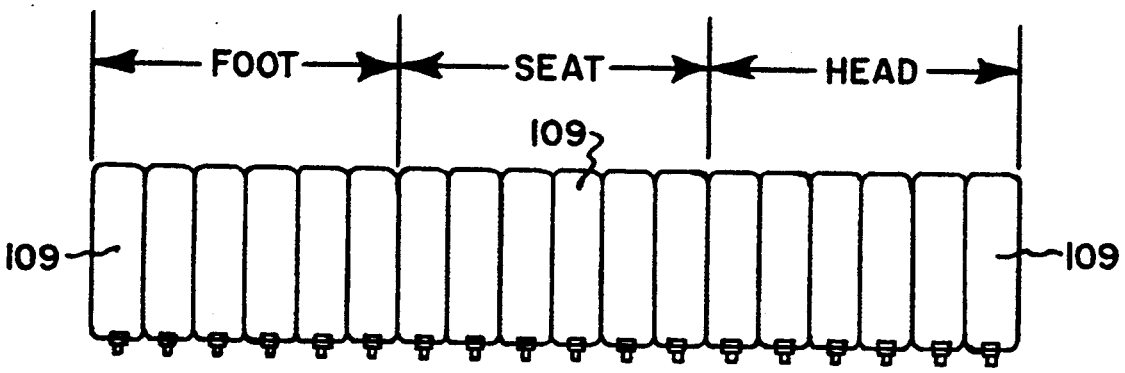
Fig. 19.

AIR SUPPORT DEVICE

FIELD OF THE INVENTION

This invention relates to an improved air support device, that has a portable embodiment and is convenient for use as a supporting mattress arrangement with standard hospital bed frames. The air support device comprises a plurality of air inflatable cells, arranged through a novel air distribution manifold and control assembly to support a novel air flow quilt which provides an upward flow of air to a patient reclining thereon, and is arranged to provide comfort and promote patient healing.

BACKGROUND OF THE INVENTION

Modern human care facilities, such as hospitals and other long and short term facilities for the sick, aged and/or infirm, have a need for a reclining patient support means such as a bed or the like that is comfortable and can reduce the problems and discomfort that a patient may experience due to sores, wounds, fractures, sprains and the like that may be tender to the touch.

In recent years there has been a recognition that air support mattresses can be beneficial to the comfort of a patient and various air support mattress arrangements have been proposed for use in human care facilities to replace the traditional bed mattress.

A particularly interesting air support mattress arrangement comprises a plurality of inflatable air sacks (cells) that are transversely arranged on a specially constructed support frame to constitute a bed. Typically the cells are connected to ports of a header, extending longitudinally along the side of the support frame, which supplies air to the cells and comprise one or more control valves or the like which regulates the amount of air being supplied to the cells. In a typical arrangement air is supplied to one side of the transversely arranged cells on the bed by a longitudinally disposed distribution chamber and air is exhausted from the other side of the cells at the other side of the bed by a corresponding exhaust chamber. Typically, a valve means is located at the exhaust side of the cells to permit regulation of the pressure and/or rate of flow of air through each of the cells or a group of cells.

Typically the distribution of air is to groups of cells, so that cells within a particular group can be provided a particular flow of air and each group of cells is arranged to engage a specific portion of the body of the reclining patient. For example, groups of cells may be arranged proximate the feet, the buttocks, the back, the head or the like of a patient and the pressure within such group of cells would be controllable as may be desired to achieve a particular comfort to all or a portion of the body of a patient reclining thereon.

Various cell designs and various arrangements thereof have been proposed which inflate and/or deflate cells at a particular portion and/or side of the bed. Thus cell designs have been advanced wherein select inflation and/or deflation cause the patient to roll or turn into a position functioning to assist the attendant in turning the patient. Designs and/or arrangements of cells provide for inflating and/or deflating various of the cells in such sequence as to impart a pulsating sensation to the patient lying thereon.

Various attachments to air support mattresses have been provided to allow use of such devices in association with non-adjustable beds. Thus, a pneumatic bellows arrangement has been proposed as an attachment, for use with an air support mattress arranged on a non-adjustable bed wherein articulated cells are in hinged relationship with an adjacent cell, to allow angular pivoting movement of a cell or group of cells of the support mattress. The bellows is arranged to angularly raise a cell or group of cells from a hinged axis, with the axis being arranged to move so as to allow a cell being angled upwardly to separate from a non angling cell and thus reduce the resistance experienced when such cell engages an adjacent cell.

An air support mattress has also been proposed wherein a plurality of transversely arranged cells are either formed of porous material or contain air escape holes that provide air circulation beneath a patient lying thereon. A multiplicity of valves are typically provided for independently controlling air flow to the plurality of cells, requiring multiple adjustments to achieve a steady state air flow at varying cell inflation pressures. The cells rest upon an articulatable bed frame and the supply of air is filtered and temperature controlled.

It is an object of the present invention to provide an air support device which can be easily retro-fitted to both adjustable and non-adjustable standard hospital beds.

It is another object of the invention to provide an air support device which is portable and can be easily and conveniently moved from bed frame to bed frame.

It is still another object of the invention to provide an air support device that will provide air circulation about the body of a patient lying thereon.

A still further object of the invention is to provide a safely reusable air support device, which comprises means for circulation of air about a patient's body.

A further object of the invention is to provide an air support device wherein the support mattress can be quickly and conveniently disconnected from the air supply means for handling and/or storage.

A still further object of the invention is to provide a means for quickly and conveniently removing air from the support mattress for emergency deflation of all or part of the device and/or storage.

Still another further object of the invention is to provide a convenient and power efficient means to control inflation and/or deflation of all or parts of the air support mattress.

Another further object of the invention is to provide an air support mattress that is simple to manufacture and assemble and convenient for user replacement of critical components.

Still another further object is to provide an air support structure that is resistant to bacterial and/or viral reverse infiltration.

Another still further object is to provide a bed comprising an air support device and supporting frame.

Another object of the invention is to provide an air flow means comprising components that can be conveniently and inexpensively replaced and/or decontaminated so that subsequent patients may utilize the air support mattress without significant fear of contamination.

Additional objects and advantages of the invention will be set forth in part in the description which follows, and in part may be obvious from the description of the invention that follows, or may be learned by practice of the invention. The objects and advantages of the invention may be realized and attained by means of the instrumentalities and combinations particularly pointed out in the appended claims.

SUMMARY OF THE INVENTION

The present invention is an air support system comprising three major component groups.

A first major component group is a generally rectangular air cell support bag which acts to secure a plurality of air cells within a desirable patient support mattress arrangement. The air cell support bag is generally formed from a flexible material such as a fabric and generally comprises a base, a top and four sides connecting the base and top. The bag is generally disassembleable, preferably has a padded base, preferably comprises an air inflation blanket as its top and is configured to secure a plurality of air inflatable cells generally along its length. The padded base configuration preferably comprises padding adjacent the longitudinal centerline region of the base. The base comprises access ports which are generally positioned to access air inflation inlets of a plurality of air inflation cells arranged within the bag.

A second major component group comprises an air flow distribution manifold. The manifold is generally formed from opposing sheets of a flexible material such as a fabric or the like and comprises a plurality of structurally connected but generally functionally autonomous tubular passageways that are arranged to extend generally along the longitudinal centerline of the base and selectively engage air inflation inlets of the plurality of transversely arranged air inflation cells through access ports of the base. For example, in an arrangement comprising eighteen air inflation cells, a manifold may comprise six connected but discrete tubular passageways, each of the passageways engaging air inflation inlets of three air inflation cells.

Generally, the tubular passageways of the manifold further comprise a rigidifying structure such as a spiral spacer or the like to prevent obstruction of air flow through collapse of the flexible material from which the tubular passageways are formed. In a preferred embodiment, the tubular passageways are connected to a gang coupling means which in turn is removably coupled to an air distribution valve means.

A third major component group comprises an air flow and manifold distribution control mechanism. Such mechanism generally comprises an air flow source for generating air flow, an air distribution valve means for distributing air flow to and/or from the various autonomous tubular passageways of the air flow manifold and/or the air inflatable blanket, and a control means for controlling the flow of air to and from the air flow source and/or the distribution of air flow to and/or from the air distribution valve means.

It should be understood that though this application specifically refers to air flow, such term is meant to include B any fluid that might be operable in the device of the invention. Thus, it is contemplated that various of the flowing liquids, solids and gases might be used in the present invention, specifically including the various compressed gases such as oxygen, carbon dioxide and the like, but, preferably air. Similarly, it should be understood that when referring herein to air impermeable material it is not meant to preclude all air flow through a material. Thus, it is contemplated that appropriate air impermeable materials include those wherein there is passage of air therethrough, but, such is so limited as to not significantly effect the normal inflation of the components of the invention so that the disclosed function thereof, in the disclosed device, is so inhibited as to be non-operable.

It is contemplated that the air inflation blanket constitute the top of the air cell support bag, or may comprise a separate structure arranged thereon. Thus, it is also contemplated that such blanket be arranged on any air support mattress structure and/or on any typical other support mattress structures of the prior art.

The air inflation blanket of the invention generally comprises opposing sheets of flexible material bonded or otherwise joined to define a confined, inflatable, air inflation space therebetween. The opposing sheets are periodically connected at locations within the air inflation space so as to form a pattern, preferably of a uniform design, upon inflation of the blanket. An inlet to the air inflation space is provided to enable the flow of air, from an air source, to the air inflation space. The connecting or joining of the opposing sheets, at periodic locations within the air inflation space, generally comprise spot connections which are arranged so as to maintain relatively unrestricted flow of air from the inlet throughout the air inflation space.

In a preferred embodiment, the upper opposing sheet comprises a material having holes through which air can flow from the air inflation space and the lower opposing sheet is air impermeable. In such preferred arrangement, the holes through which air can flow are sized such that air inflation of the blanket is maintained as air flows through the upper sheet. In a further preferred embodiment, the lower opposing sheet comprises an air impermeable material such as a coated fabric, for example urethane coated nylon or the like, and the upper opposing sheet comprises a material having microscopic pores therein through which air can pass.

Generally, it is preferred to arrange connections between the upper and lower sheets so as to form a pattern comprising connections at corners of multiple abutting inflated polygons. It has been found that if the upper sheet is joined by spot welding, gluing or the like to the lower sheet so as to form a pattern such as squares having sides from about 1½" to about 2½" that upon inflation to a pressure from about 2 inches $H_2O$ to about 16 inches $H_2O$, the polygon will attain a domed configuration, that upon inflation of the air inflation space appears as a domed quilt arrangement, which is particularly suitable to the comfort and healing of a patient lying thereon. Interestingly, the configuration of the inflated polygons appear to provide significant reduction to the interface pressure on the wound.

Capillary closure pressure is generally defined as the blood pressure in a capillary sufficient to resist the closure of that capillary by a force, generally termed interface pressure, against the capillary. In a healthy person, the blood pressure in capillaries close to the skin are typically 36 mm Hg. The sick and infirm may have capillary blood pressures as low as 25 mm Hg. Tissue nourishment occurs with blood flow at the capillary level and an interface pressure against the capillary, which exceeds the capillary blood pressure, will generally collapse the capillary and prevent blood flow.

Generally, an interface pressure sufficient to collapse a capillary is not enough to cause pain. When the blood flow stops, cellular damage begins around the closed capillary within about thirty minutes, and the individual may not experience pain sufficient to warn of the damage being incurred. Without pressure relief, a bed sore can be created within about eight hours. Normally, patients who are at risk for pressure sores, e.g. comatose, sedated, paralyzed, critically ill, geriatric and neurologically injured patients are turned about every two hours to prevent sores induced through interface pressures, incurred through the weight of their body, which close capillaries. Patients suffering from tissue trauma through burns, plastic surgery and the like are also particularly susceptible to tissue damage incurred through imposition of inappropriate interface pressures.

In 1989, the Wound Ostomy and Continence Nurses Association reported that there were 1,500,000 bed sores annularly. In 1992, this association reports that there were over 2,000,000 bed sores. Conventional methods requiring high levels of nursing intervention appear to be insufficient.

In a further preferred embodiment of the invention, the upper sheet of the blanket is of an air permeable laminate construction containing an upper laminate layer of a microporous fabric through which air can flow but which resists the flow of liquids, and most preferably is also coated with a bacteriostat and/or an antiviral composition. Generally, it is preferred that the microporous layer have a porosity from about 0.001 to about 0.5 microns. Such laminate construction has proved advantageous in patient care in that it resists the spread of infection, particularly the reverse infiltration of infectious bacteria and/or virus to other components of the air support system and/or such support mattress on which it is arranged.

In a further preferred embodiment, the upper layer comprises a solvent phobic material. By solvent phobic material is meant a material which is generally non wetting to solvents used in a medical treatment environment and more particularly comprises a material that is non wetting to solvents having a surface tension above about 20 dynes/cm$^2$. Thus, in a particularly preferred embodiment the upper layer comprises a material and/or coating or the like which does not wet out with solvents such as alcohol, water and the like.

The base of the air cell support bag is preferably formed from a flexible material and most preferably comprises opposing sheets of flexible fabric which form an envelope containing a pliant support material, such as a padding as for example foam rubber or the like, between the sheets. The padding is preferably arranged adjacent the longitudinal centerline of the base and supports the sheets, adjacent the longitudinal centerline of said base, in spaced relationship. The access ports are generally positioned about along the longitudinal centerline of the base, in the area that is not padded, and the padded area is preferably sized such that the tubular passageways of the air flow distribution manifold can be arranged in the non-padded area therebetween. It should be understood that by the term about along the longitudinal centerline is meant along the centerline and/or adjacent to the centerline. Such arrangement of the non-padded area can provide added comfort for the patient lying thereon. It should be understood that the invention also contemplates that the base of the air support bag be non-padded and/or that a separate pad be arranged thereunder and/or that the base is fully padded.

The cells contained in the air cell support bag are preferably configured to have a generally rectangular shape upon inflation and are sized such that they generally fill the volume of the air support bag when inflated to their maximum. It should be understood however that the air cells may comprise any convenient shape and that it is contemplated as within the broad invention that the air cells may be of any convenient size and/or shape specifically including rounded, oblong, cylindrical, spherical and various specialty shaped cells of the prior art which may be arranged for assisting in turning and/or pulsing a patient reclining thereon.

In a preferred embodiment, an air cell, formed from a flexible material, further comprises one or more support baffles which extend between generally vertically oriented opposing walls of the air cell. The baffles are sized to maintain the geometric integrity, at inflation, of such opposing walls of the air cell and limit the extent of domeing of the flexible material comprising the walls. The baffles are generally horizontally arranged and either comprise air flow passageways therein and/or do not engage all sides of the air cell so that air may flow throughout the air cell from an inlet. In a further preferred embodiment, a support baffle comprises a rectangular sheet of material which is joined at about its lengthwise borders to opposing, longitudinally extending, generally vertically oriented sides of a generally rectangular air cell. The ends, e.g. width of the baffle, are not joined to the ends of the air cell and air flows from an inlet throughout the air cell. Most preferably, the rectangular air cell comprises two baffles in generally parallel, generally horizontal arrangement within the air cell.

It should be understood that the form of the air cell comprising the baffle of the invention need not be polygonal but may be cylindrical or the like and engagement of the baffle with the side wall is between opposing locations on the side wall.

The arrangement of the cells within the bag is generally in parallel traverse order but it is contemplated as within the invention to incorporate longitudinally extending cells. For example in a preferred embodiment of the invention a plurality of air cells are arranged to traverse the width of the bag in parallel array. In a further embodiment, air cells at the foot and/or head of the bed are arranged to traverse the width of the bag and air cells in the middle of the bag are arranged parallel to the longitudinal axes of the bag, and/or vice versa. Generally, adjacent air cells are arranged such that upon inflation, they will engage adjacent cells in the air cell support bag. It should be understood that though it is not required, the invention contemplates the presence of stiffening members being placed between cells and/or at an end and/or side of the bag to assist in maintaining the form of the bag upon inflation of the cells therein.

The air flow inlet is arranged in a cell such that it faces the base of the bag for attachment to the air flow distribution manifold. Though it should be understood that different size and shape cells may be utilized in a bag, it is generally preferred that each of the cells be of about the same size and shape and that the air flow inlet of each cell be arranged at about the same location in each cell. Though location of the air flow inlet of a cell can be such that it will engage the air distribution manifold at the longitudinal centerline of the base, it is preferred that the inlet be arranged on the cell such that it engages the air distribution manifold at a point adjacent the longitudinal centerline of the base of the bag. The cells are generally formed from an air impermeable fabric and are preferably manufactured from a urethane coated nylon fabric or the like air impermeable material.

The air flow distribution manifold of the invention comprises a plurality of tubular passageways that extend from an air flow distribution control mechanism to the cells of the air cell support bag and alternately to the air flow blanket. In a preferred embodiment of the invention the tubular passageways are structurally connected to provide a unitized component. Thus, preferably the air flow distribution manifold is formed from a flexible material and most preferably comprises opposing sheets of flexible air impermeable material which are joined to define a plurality of separate passageways. It has been found that a air impermeable coated fabric, such as a urethane coated nylon fabric or the like, constitutes a preferred material for the opposing sheets as it can be conveniently welded and/or glued to form leak resistant separate passageways of the manifold.

In a preferred embodiment of the aforesaid air flow distribution manifold, wherein it is desired to functionally control the air inflation of 18 air inflation cells in units of 3 cells, six separate passageways can be conveniently welded into a generally rectangular arrangement of opposing sheets of urethane coated nylon fabric such that inlets to the passageways can be arranged in a parallel array for connection to a gang coupler of a controlled air supply source. In such arrangement it is preferred that the passageways be configured such that air flow inlets of cells closest to the air supply source be connected to passageways closest to the longitudinal centerline of the manifold. Thus, passageways that serve closer cells can be ended so that the path of adjacent passageways can be directed nearest the centerline to service subsequent cells. Using such arrangement, outlets from the multiple passageways can be arranged along a single path or along two paths equidistant from the centerline of the base of the air cell support bag. Such arrangement of outlets provides consistency in placement of cell air flow inlets and allows the cells to be interchangeable.

In a further preferred embodiment of the invention, novel air flow connectors are provided, comprising first and second mating members, which engage to form a leak resistant connection for the flow of air between the passageways of the air distribution manifold and the cells. The first mating member comprises opposing first and second rings, which engage each other and opposite surfaces of a sheet of fabric to form a circular port through the fabric. The first opposing ring of the first mating member comprises a cylindrical shoulder, extending from a side of the ring, which defines its central port, and a locking bar that extends across the defined central port from opposite points on the cylindrical shoulder. The cylindrical shoulder of the first opposing ring engages the central port of the second opposing ring.

The second mating member also comprises opposing rings which engage each other and opposite surfaces of the fabric to form a circular port. One opposing ring comprises first and second cylindrical shoulders, preferably extending from opposite sides of the ring, which define its central port. A first cylindrical shoulder is sized to insert into the central port defined by the cylindrical shoulder of the first opposing ring of the first mating member, is slotted in a first direction to receive the locking bar as the shoulder is being inserted into the first mating member and is then slotted in a changed direction to allow locking of the shoulder against the locking bar through turning of the second mating member within the port of the first mating member. The second cylindrical shoulder is sized to engage the central port of the other opposing ring such that the rings engage each other and opposite surfaces of a sheet of fabric to form a circular port through the fabric. It should be understood it is specifically contemplated as within the invention that the shoulders of the second mating member extend from the same side of a ring.

Either of the mating members of the novel connectors can be positioned in either the passageways of the manifold or air flow inlet of the cells, however, it is generally preferred that the mating member constituting the slotted shoulder comprise the air flow inlet of the cells.

The air flow and manifold distribution control mechanism of the invention comprises an air flow source for generating air flow, an air distribution valve means for distributing air flow to and/or from the various passageways of the air flow manifold and/or the air inflatable quilt, and a control means for controlling the flow and/or distribution of air to and from the manifold and/or quilt.

The device of the invention contemplates the use of any suitable air flow source means, however, the preferred air flow source means comprises a motor driven fan, mounted in a suitable pump housing such that rotation of the fan provides a pressurized air flow at an outlet of the pump housing. Preferably, the fan is driven by a variable speed motor to enable generation of variable flow and pressures through the outlet by fan speed control. Generally, appropriate variable speed electric motors operate with direct current and generally it is preferred that the direct current operating voltage be maintained as low as possible for use in a patient environment.

The invention contemplates the use of any suitable valve and control means for the distribution of air flow to the manifold and/or the blanket, however, novel means are also herewith provided. A particularly preferred valve means for the distribution of air to the air flow manifold comprises a port select valve structure wherein the flow of air from the air flow source is directed through a port select element comprising a plurality of spaced ports of varying size and/or shape. The port select element is rotatably mounted within a housing which also comprises ports therein having passageways to outlets from the housing. The ports of the rotatable port select element align with various ports of the housing at various positions of rotation to allow air flow therethrough. The mounting of the port select element within the housing is preferably such as to provide a bearing surface for rotation and provide resistance to air flow leakage between the bearing surface of the housing and/or the port select element. Generally it is also preferred that the outlets from the housing be easily disconnected from passageways of the manifold. A most preferred means is a gang disconnect coupler which provides common disconnect of passageways of the manifold from the housing outlets.

In a preferred arrangement, the rotation of the port select element is electric motor driven. Motor activation is controlled by switching and switching is instituted through programed sequencing. Thus, in a preferred embodiment of the invention, the incidence, pressure, flow and temperature of air flow to the various cells and/or air inflation blanket of the invention is controlled through a programmed microprocessor means, which acts in initiation and/or termination of rotation of the port select element to select port positions alternately coupled with motor speed of the air flow source. In a typical such environment, the microprocessor comprises comparator means which interacts with sensor means and memory means to provide activating signals to switching means that initiate and/or terminate rotation of the rotatable port select element and/or vary quantity of air flow from the air flow source.

In a further preferred embodiment of the invention, the housing of the port select valve structure comprises air vent adjustment means at the outlet of the ports contained therein to allow a more precise adjustment of cell and/or blanket inflation. In a still further preferred embodiment of the invention the inlet of the air flow source is also connected through the port select element and housing. In such arrangement, at a defined position in rotation of the port select element, air flow from an air flow pumping source is diverted from passing through the port select element and a suction is imposed, through the element, on select ports of the housing from connection with the intake side of an air flow source. When the rotatable element is in an operating position where air flow is to the cells and/or air inflation blanket, air flow to the inlet of the air flow source is diverted from passing through the rotatable element.

Such arrangement enables a rapid suction evacuation of air from one or more cells and/or the blanket of the invention, as desired, through positioning of the port select element. As can be seen, such enablement can provide a convenient and rapid means to evacuate air from all or a portion of the mattress and/or blanket in the event of an emergency or for convenient storage of the device.

The advantages of the invention can be appreciated more fully by reference to the enclosed drawings which depict embodiments of the invention in more detail

BRIEF DESCRIPTION OF THE DRAWINGS

FIG. 10 is an exploded, partial sectional, perspective view of an air flow distribution manifold and cell of the invention.

FIG. 11 is a sectional view taken along about line 11—11 of FIG. 10.

FIG. 12 is an exploded sectional view of an air flow connector of the invention taken along about line 12—12 of FIG. 10.

FIG. 13 is a sectional view taken along about line 13—13 of FIG. 12.

FIG. 14 is a sectional view taken along about line 14—14 of FIG. 12.

FIG. 16 is a sectional view taken along about line 16—16 of FIG. 15.

FIG. 17 is an enlarged view of the area designated FIG. 17 in FIG. 16.

FIG. 18 is a sectional view taken along about line 18—18 of FIG. 15.

FIG. 19 is a side elevational view showing an arrangement of cells of the invention.

DETAILED DESCRIPTION OF THE DRAWINGS

Figures 1, 2:
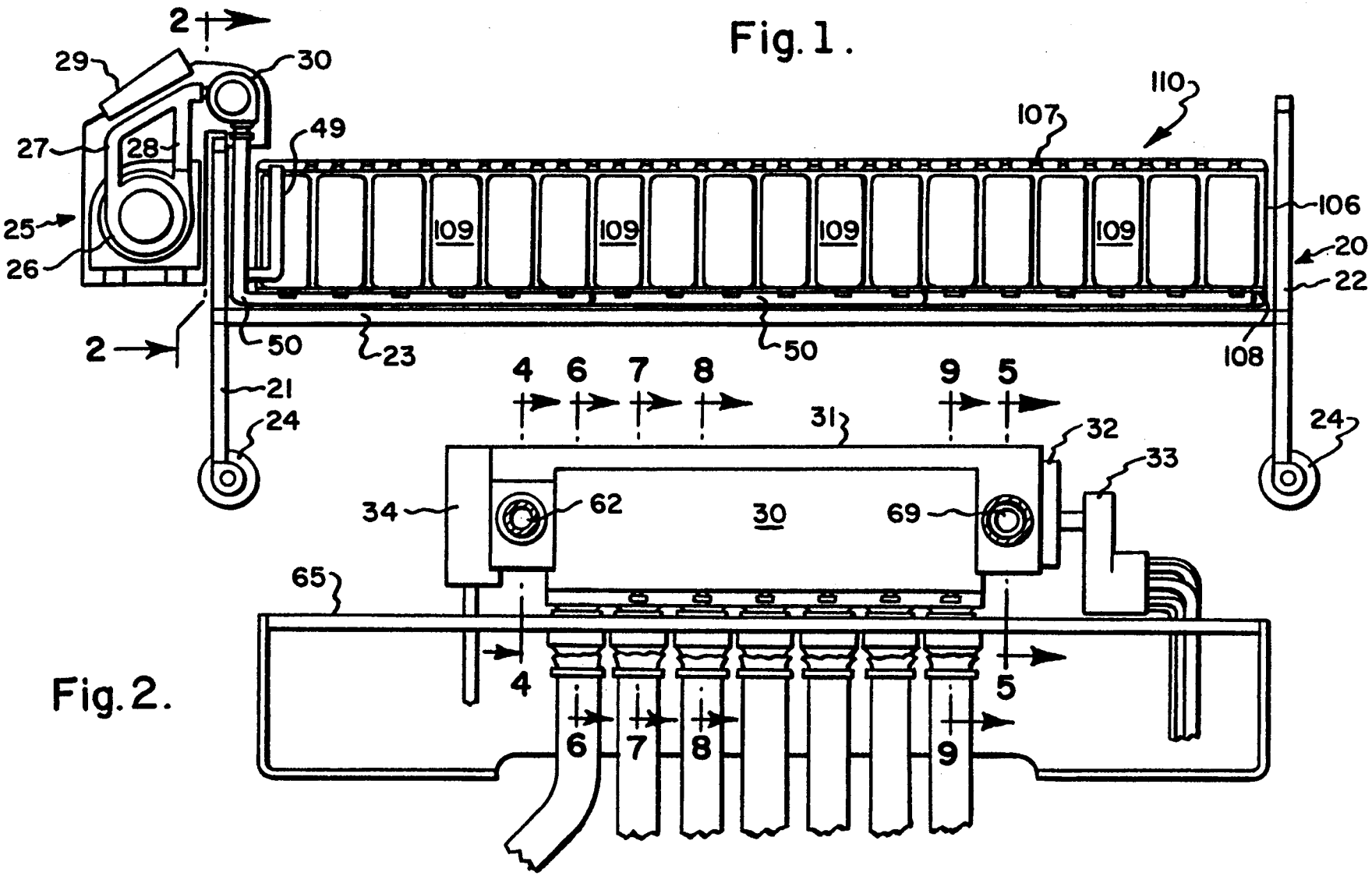
FIG. 1 is a side elevational view of a hospital bed to which the invention has been applied.
FIG. 2 is a partial sectional view taken along about line 2—2 of FIG. 1, showing an air distribution valve of the invention.

Referring first to FIG. 1, therein is shown an air support device, comprising a distribution valve of the invention, with components in a typical arrangement on a standard hospital bed frame. In this embodiment of the invention, bed frame 20 comprises vertical foot board frame assembly 21, vertical headboard frame assembly 22, mattress support frame assembly 23 extending therebetween and casters 24. Generally, mattress support frame assembly 23 comprises means (not shown) for articulating a mattress supported thereon, generally by raising an end or an intermediate section of the mattress.

Air support mattress 110 is illustrated as generally comprising air cell support bag 105, having sides 106, top 107, base 108 and air cells 109. Air flow distribution manifold 50 can generally be considered a part of the support mattress, for illustration purposes, and would typically be articulated as part of the mattress when arranged on an articulatable mattress support frame assembly.

Air supply source 25 is illustrated as generally comprising air flow pump 26, air flow conduits 27 and 28, and air flow distribution valve 30 in switching arrangement with microprocessor control console 29 to provide a flow of air through air supply tube 49 to top 107, and through air flow distribution manifold 50 to air cells 109.

Figures 3, 3A, 3B:
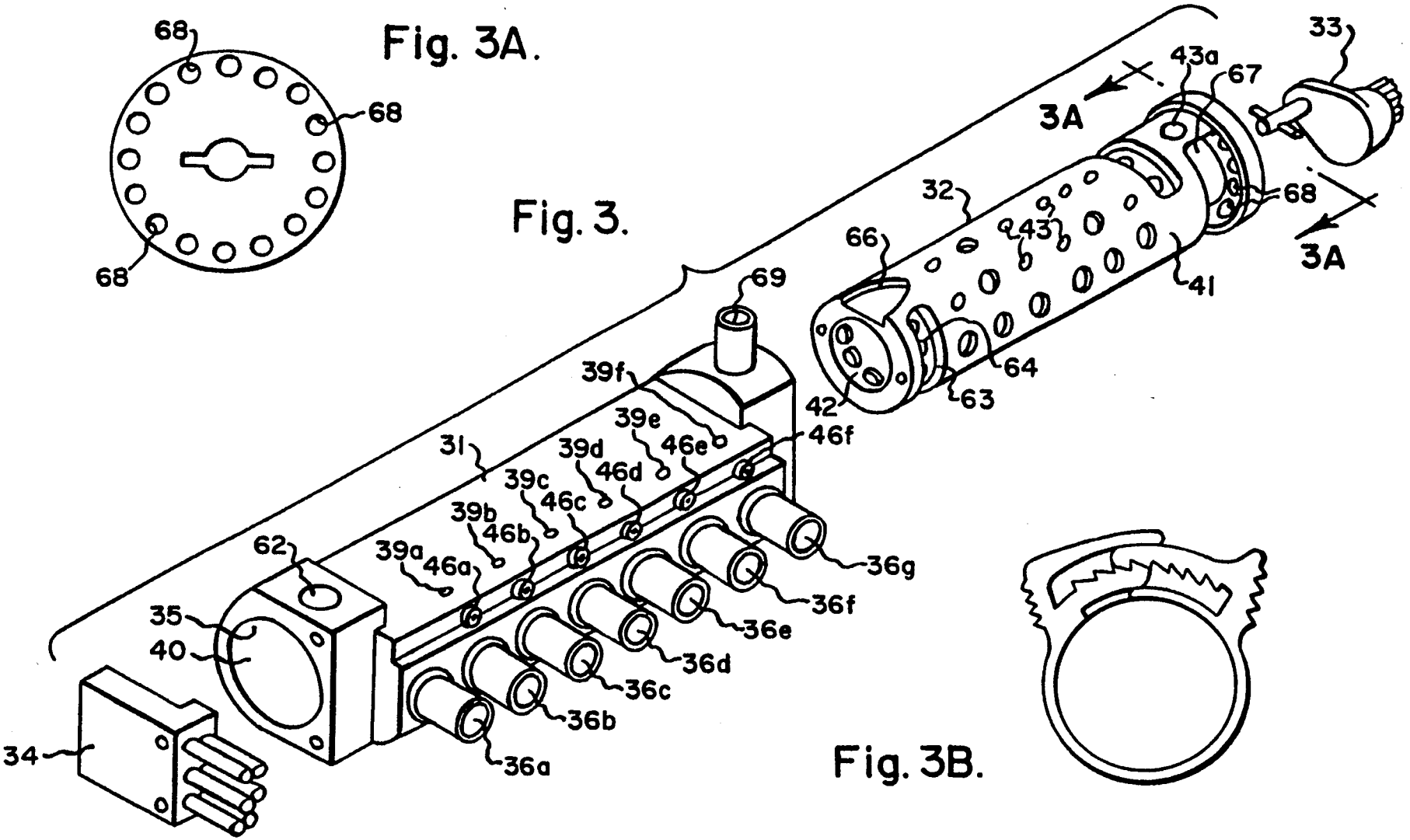
FIG. 3 is an exploded perspective view of the air distribution valve of FIG. 2.
FIG. 3A is a sectional view taken along about line 3A—3A of FIG. 3.
FIG. 3B is a front elevational view of an embodiment of an attachment clip of the invention.
Figure 4:
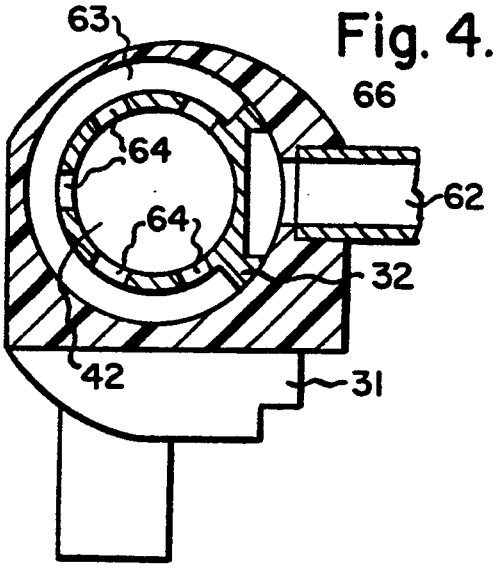
FIG. 4 is a sectional view taken along about line 4—4 of FIG. 2.
Figure 5:
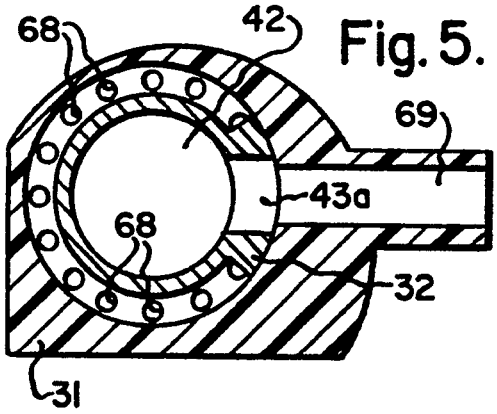
FIG. 5 is a sectional view taken along about line 5—5 of FIG. 2.
Figure 6:
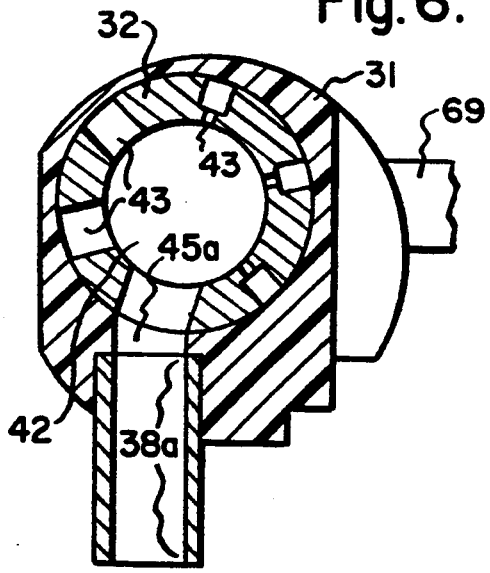
FIG. 6 is a sectional view taken along about line 6—6 of FIG. 2.
Figure 7:
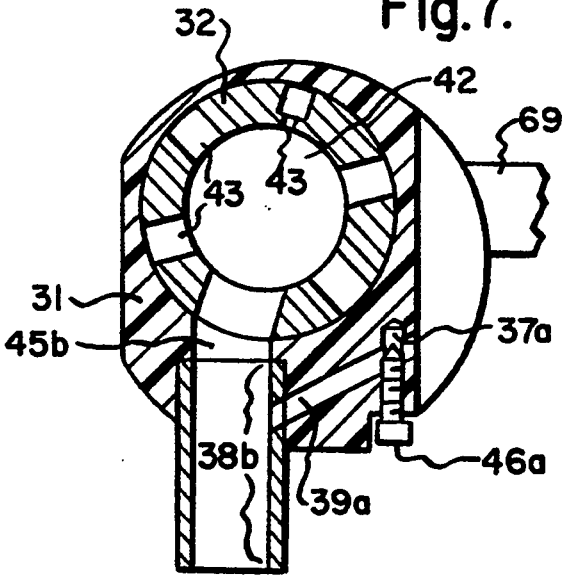
FIG. 7 is a sectional view taken along about line 7—7 of FIG. 2.
Figure 8:
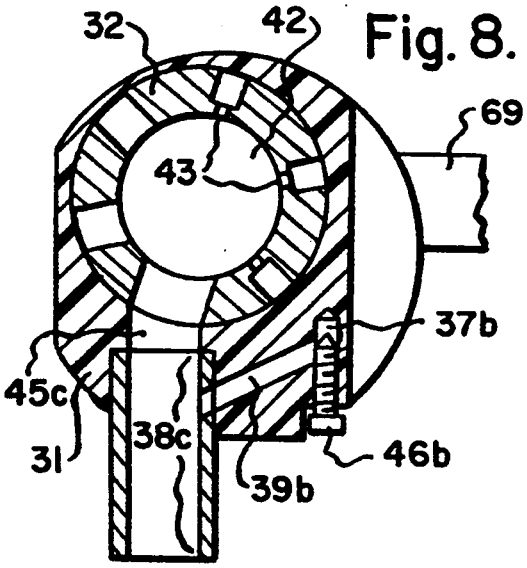
FIG. 8 is a sectional view taken along about line 8—8 of FIG. 2.
Figure 9:
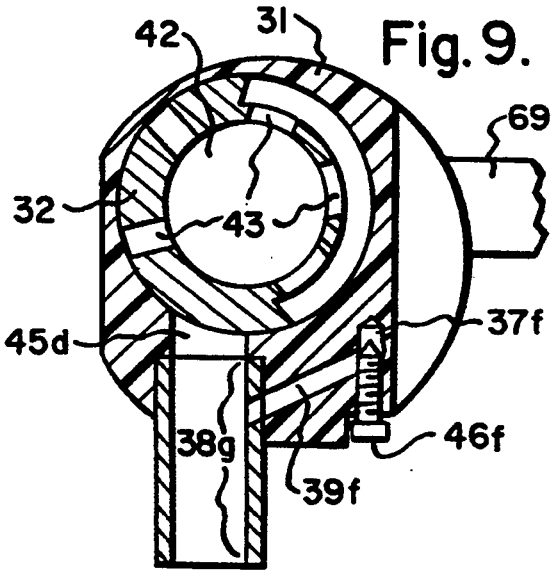
FIG. 9 is a sectional view taken along about line 9—9 of FIG. 2.

Referring now to FIGS. 10 and 11, therein is illustrated a preferred embodiment of an air flow distribution manifold of the invention. Air flow distribution manifold 50 is illustrated as comprising opposing sheets of longitudinally extending flexible fabric 51 and 52 which are joined at spaced, longitudinally extending welds 53 to form discrete passageways 54–59, having inlets 60*a–f* and outlets 54*a–c*, 55*a–c*, 56*a–c*, 57*a–c*, 58*a–c* and 59*a–c*. It should be understood that though six passageways are depicted, it is contemplated as within the invention to have any convenient number of passageways connected to any convenient number of air support cells. The passageways are illustrated as comprising spiral wound spacers 61 to resist collapse of the passageways and inlets 60*a–f* are shown as being connected, by means of an adjustable ratchet connector as depicted in FIG. 3B, to gang coupler 65 for quick-connect and disconnect to the air distribution valve assembly. Air supply tube 49 is also shown as being connected to coupler 65 and provides air flow to an air support blanket. Outlets 54*a–c*, 55*a–c*, 56*a–c*, 57*a–c*, 58*a–c* and 59*a–c* are shown as comprising a mating member of an air flow connector which is shown in detail in FIGS. 12–14.

The positioning of the outlets of the manifold is illustrated as being adjacent the longitudinal centerline of the manifold with outlets being in opposite staggered direction from the centerline and equidistant along the centerline. In such arrangement, outlets of a passageway are arranged to provide a flow of air to every other air cell and air cells are interchangeable with each other. Thus two discrete passageways can provide flow of air to a particular group of six air cells and provide air flow variations between adjacent cells.

Air cell 109 is illustrated in the embodiment of FIG. 10 as being generally rectangular, comprising generally vertical opposing walls 96, 97 and having baffles 98 and 99 extending therebetween, being joined to walls 97 and 98 along about their lengthwise borders 101 and 102. The illustrated baffles comprise a flexible fabric and are not joined at their ends to the ends of the air cell, thus allowing flow of air throughout the air cell from the inlet. Generally the baffles are joined to the walls by welding gluing or the like. It should be understood that it is contemplated as within the invention that the baffles are formed from a rigid material and/or may comprise holes or the like therethrough for the flow of air.

FIG. 12, depicts an exploded sectional elevation of an air flow connector between an outlet of the air flow distribution manifold of FIG. 10 and an air cell. Therein air flow connecter 70 is illustrated as comprising first and second mating members 71 and 72 respectively. It should be understood that though either mating member can be affixed to either a cell or the manifold the illustrated embodiment provides the first mating member affixed to the manifold and the second member affixed to the cell.

In the drawings, first mating member 71 comprises opposing first and second rings 73 and 78 respectively. First ring 73 comprises attachment side 74 and outwardly extending cylindrical shoulder 75 which is arranged circumferentially to define circular passageway 77 having surface 76. Second ring 78 comprises attachment side 79 and interior surface 81 defining a circular port which is sized to engage surface 76 of outwardly extending shoulder 75. Locking bar 82 inserts through shoulder 75 and bisects circular port 77. In the illustrated embodiment, circular ports are made in flexible fabric sheet 51 of the air flow distribution manifold and shoulder 75 of first ring 73 is inserted therethrough such that attachment side 74 engages a side of the sheet. Second ring 78 is fitted over surface 76 of shoulder 75 such that attachment side 79 thereof engages the other side of the sheet. Typically all engaging surfaces are glued or the like to provide a secure, leak free attachment of the first mating member to the manifold.

Second mating member 72 comprises opposing third and fourth rings 83 and 91 respectively. First ring 83 comprises attachment side 84, outwardly extending first cylindrical shoulder 85 having cylindrical surface 86 and outwardly extending second shoulder 88 having surface 89 arranged circumferentially about circular port 87. Second outwardly extending shoulder 88 is sized for insertion within port 77 of first ring 73 of first mating member 71 and comprises a slot 90 which is positioned and sized to accept locking bar 82. Fourth ring 91 comprises attachment side 92 and has a port which is sized to receive surface 86 of outwardly extending first shoulder 85.

In the illustrated embodiment, a circular port is made in the flexible fabric sheet of an air cell and shoulder 85 of third ring 83 is inserted therethrough such that attachment side 84 engages a side of the sheet. Fourth ring 91 is fitted over surface 86 of shoulder 85 such that attachment side 92 thereof engages the other side of the sheet. Typically all engaging surfaces are glued or the like to provide a secure, leak free attachment of the second mating member to the air cell.

In attachment of the first and second mating members, typically an elastomeric sealing ring 95 is mounted over surface 89 of second shoulder 88. Second shoulder 88 of second mating member 72 is inserted within port 77 of first ring 73 of first mating member 71, with slot 90 accepting locking bar 82 therein. Twist turning of the second mating member locks the changed direction of slot 90 against locking bar 82 and holds the mating members together.

Referring now to FIGS. 15–19 wherein a preferred arrangement of the air support mattress of the invention is illustrated in exploded perspective view. In the embodiment air support mattress 110 is shown as generally comprising air cell support bag 105, having sides 106*a–d*, top 107 and base 108. A plurality of air cells 109 are shown as transversely arranged along the length of and within air bag 105, with inlets of the air cells connecting with outlets of air flow distribution manifold 50. It should be understood that the air distribution manifold is presented as a part of the air support mattress for illustration purposes.

In the illustrated embodiment, top 107 of air cell support bag 105 is shown in a preferred embodiment as comprising an air flow blanket, and sides 106*a–d* are shown as comprising zippers 111*a–d* for attachment to corresponding zippers 112*a–d* of base 108. Generally, opposing ends 115*a* and 115*b* of the sides are joined, as are ends 115*c* and *d*, 115*e* and *f*, and 115*g* and *h*, to firmly envelope the air cells within the air support bag. Base 108 is shown in the preferred embodiment of FIGS. 15 and 18 as constituting opposing sheets of flexible fabric 113 and 114, joined around their periphery and comprising zippers 112*a–d* for attachment to the sides. It should be understood that the embodiment of zipper attachment means amongst the sides and base can be a single continuous zipper or any suitable combination. In a further preferred embodiment other attachment means are contemplated, including hook and loop attachment means, snap attachment means and the like.

Figure 15:
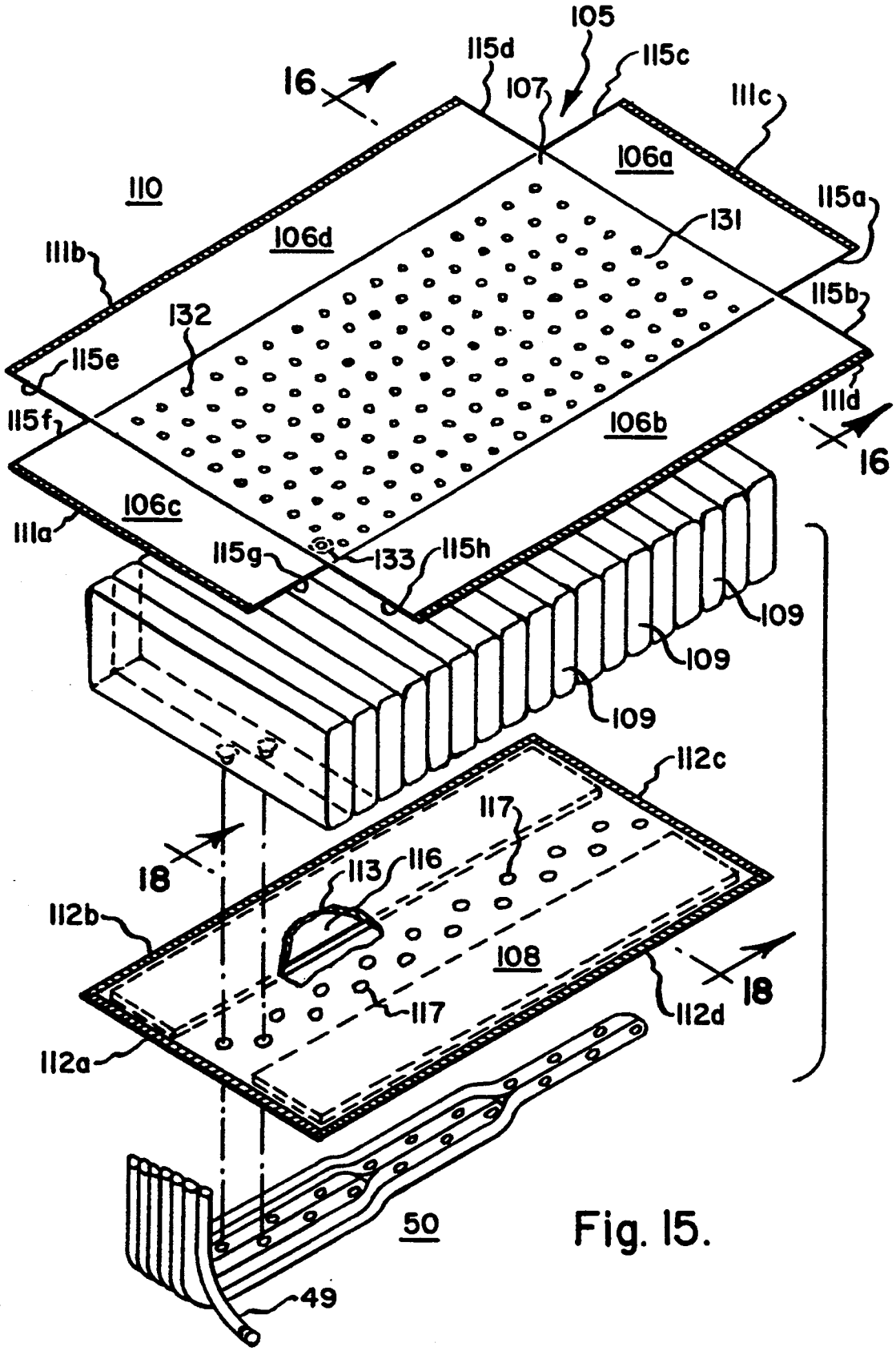
FIG. 15 is an exploded perspective view of an air support mattress assembly of the invention.

In the preferred embodiment of FIGS. 15 and 18, base 108 is shown as constituting spacer 116 arranged between the opposing sheets of fabric and extending adjacent about air distribution manifold 50 in a position generally adjacent the longitudinal centerline of the base. In the a most preferred embodiment spacer 116 constitutes a pliant support material such as a foam rubber, padding or the like material. In a further preferred embodiment spacer 116 is shaped along the edge opposing the air distribution manifold to generally mate therewith. It is desirable to join opposing sheets of fabric 113 and 114 and/or spacer 116 to a sheet to prevent movement.

In the preferred embodiment shown, base 108 comprises ports 117 arranged adjacent the longitudinal centerline of the base and positioned to correspond with the outlets of air distribution manifold 50 and inlets of the air cells to facilitate connection of an air distribution manifold arranged outside the air support bag. It is contemplated that the air distribution manifold can be arranged within the air support bag extending through a side thereof, in which circumstance ports 117 would not be necessary but a port for insertion of the manifold in the side would be.

FIG. 19 illustrates a typical functional arrangement of air cells within an air cell support bag. Therein, eighteen air cells are arranged in three prominent groupings; foot, seat and head, with each group being served by two parallel passageways. The air distribution manifold is illustrated as comprising six longitudinally extending passageways, pairs of which terminate at the end of the group which they service. Thus, a group of air cells representing the foot of the mattress connects with the two central parallel passageways of the air distribution manifold that are closest to the longitudinal centerline of the manifold and the passageways terminate at the end of the group. Adjacent parallel passageways of the manifold converge toward the longitudinal centerline thereof, at the end of the foot grouping, and serve the group of air cells representing the center or seat group, terminating at the end of the group. Again adjacent parallel passageways of the manifold converge toward the centerline at the end of the seat grouping to serve the head grouping. Each of the two passageways serving a group, provides air flow to half of the air support cells in the group and preferably to every other cell of a group. Thus, by manipulation of air flow to the passageway of a manifold, the air flow to every other cell in a group can varied and/or the air flow to each group can be varied.

FIGS. 15, 16 and 17 illustrate the air support blanket of the invention in a preferred embodiment wherein it comprises the top of air support bag 105. The top is illustrated as a layered structure having a bottom layer 125, and a laminated top layer 128 comprising under layer 126 and upper layer 127. In a preferred embodiment bottom layer 125 comprises an air impermeable material such as a coated fabric, for example urethane coated nylon or the like. In the illustrated embodiment top layer 128 comprises upper layer 127 and under layer 126, arranged in an air permeable laminate construction wherein underlayer 126 is an air permeable material and upper layer 127 is a microporous material having restricted air permeability illustrated as generally containing micropores (not shown) through which air may pass. The micropores are generally in a random arrangement and sized to have an average opening of less than about 0.5 microns. Though it is not specifically illustrated it is considered within the understanding of the invention to coat or otherwise treat top layer 128 with a bacteriostat and/or an antiviral composition that resists infiltration of bacterial and/or viral compositions.

In the illustrated embodiment top layer 128 is joined or otherwise connected, preferably by welding and/or gluing along a border to bottom layer 125 to define air inflation area 131. Bottom layer 125 and top layer 128 are also periodically connected, at locations within the air inflation area, preferably by periodic welds 132, so as to form a pattern within air inflation area 131. Inlet 133 is provided to the air inflation area to enable the flow of airs from air supply tube 49, to air inflation area 131 between the top and bottom layers.

Referring now to FIG. 15, therein periodic welds 132 are illustrated as arranged in a pattern such that air inflation area 131 comprises multiple abutting inflated squares. FIG. 17 shows that upon inflation, the polygons attain a domed configuration, that appears as a quilt arrangement, which is particularly suitable to the comfort and healing of a patient lying thereon.

Referring now to FIGS. 2–9, therein is illustrated an embodiment of an air distribution valve assembly particularly suitable for distributing flow of air to passageways of an air distribution manifold of the invention. Reference is herewith incorporated to copending U.S. application Ser. No. 030,634, filed on even date herewith, still pending wherein an illustrated preferred air distribution valve and/or valve assembly is described in further detail.

In the figures, air distribution valve 30 is illustrated in arrangement with gang coupler 65 to show a preferred rapid connect, disconnect arrangement of multiple air transmission passageways to the air distribution valve. Therein, air distribution valve 30 is illustrated as comprising housing 31, rotatable port select element 32, rotatable element drive assembly 33 and position sensor assembly 34.

Housing 31 comprises longitudinally extending hollow chamber 40, which has a rounded surface 35 containing ports 45*a–g* to passageways 38*a–g* respectively and having outlets 36*a–g* respectively. Air vent passageways 39*a–f*, are in contiguous fluid communication with outlet passageways 38*b–g* respectively and vent to atmosphere. Adjustable flow needle assemblies 46*a–f* are mounted through threaded passageways 37*a–f*, to intersect air vent passageways 39*a–f* respectively in an arrangement such that the flow of air through air release passageways 39*a–f* varies with inward and outward adjustment of the flow needle.

Port select element 32 comprises rounded surface 41 and is sized to insert within hollow chamber 40 in cooperating engagement with rounded surface 35. Element 32 comprises interior manifold chamber 42 and a plurality of spaced ports 43, of varying size and/or shape, positioned to be in fluid communication with various of ports 45*a–g* of outlet passageways 38*a–g* as the port select element is turned within housing 31. Inlet slot 63 extends about port select element 32 and comprises apertures 64 to interior manifold chamber 42. Housing inlet 62 is in fluid communication with the outlet of the air supply pump. Inlet slot 63 of port select element 32 is in fluid communication with housing inlet 62 and, through apertures 64, with interior manifold chamber 42 through various positions of rotation of port select element 32 in air supply to the valve. At what may be termed a evacuation position in rotation of port select element 32, housing inlet 62 is in communication with diverting slot 66 of port select element 32, which diverts fluid flow from housing inlet 65 from communication with interior manifold chamber 42.

Housing outlet 69 is in fluid communication with the intake side of the air supply pump. Through various positions of rotation of port select element 32 in air supply to the valve, shunt slot 67 is in fluid communication with shunt slot apertures 68 to the atmosphere. Thus, air intake to the air supply pump for supplying air to the valve generally flows from the atmosphere through shunt slot apertures 68 to shunt slot 67 and through housing outlet 69 to the intake side of the air supply pump.

At an evacuation position in rotation of port select element 32, outlet port 43*a* aligns with housing outlet 69 and air intake to the air supply pump is in fluid communication with interior manifold chamber 42 of rotatable element 32. Housing inlet 62 is in communication with diverting slot 66 of port select element 32, and fluid flow from housing inlet 62 is diverted to atmosphere. Thus, in the air evacuation position of port select element 32, air is sucked into the pump and to atmosphere through interior manifold chamber 42 from the passageways of the outlets of the housing and from components in fluid communication therewith.

In a preferred arrangement, the port select element is connected to a drive assembly with the position of the rotation of the port select element being defined through position sensor 34 in cooperating engagement with the microprocessor console. In a particularly preferred arrangement the position sensor comprises a cam that rotates in cooperative engagement with rotation of the rotatable member and engages micro-switches that are in communication with the microprocessor. The microprocessor comprises a memory means to which data from the micro-switches is compared by a comparator means which initiates the activity of the drive assembly in response thereto.

In a typical air support mattress arrangement, one or more elevation sensor switches are mounted with the air support mattress on and/or integral with an articulatable bed frame and are in communication with the microprocessor. A comparator portion of the microprocessor is programed to position the rotation of the port select element to various positions and various air supply pump speeds with the influx of data that it receives from a memory portion of the microprocessor and/or operator interceding switching means. A memory portion of the microprocessor comprises data relevant to various multiple conditions that may be invoked. The operator enters data to the microprocessor comprising physical characteristics such as weight, weight distribution, size, wound location, type, pulsation and the like of a patient to be reclining thereon. Comparator means compares such data to data in the memory means and generally selects signals for positioning of rotation of the port select member and air pump speed accordingly. Switching means, remote and/or on the console, allow interruption by the operator and generally provide direct interaction with signal selection through the comparator means, typically to preset conditions, such as mattress deflation, emergency CPR deflation and the like. Elevation sensing means generally also interact with comparator means in the selection of data from the memory means in the event of articulation of the support mattress from a generally horizontal position.

Through the aforesaid, the inflation of the multiplicity of individual air cells as well as the air inflatable blanket can be easily customized to provide individualized stress relief to multiple different patients under multiple different conditions. Patients of various lengths, weights and weight distributions can be supported about various parts of their body with differing degrees of firmness. Arrangements of cells of various shapes can be inflated to varying degrees to assist in turning a patient and/or for various pulsation effects or the like. Articulating of the hospital bed to various elevations can be accompanied by changes of air cell inflation to facilitate mattress and/or patient articulation.

We claim:

1. A support device, adapted for placement on a bed frame comprising:

a fluid cell support bag having a base, a top and sides, said bag being configured to hold a plurality of fluid inflatable cells;

a plurality of fluid inflatable cells, arranged within said bag, along the length of said bag;

said top of said bag comprising upper and lower sheets of flexible material arranged in opposing juxtaposition, having an inlet to a space therebetween, said sheets of flexible material being joined to enable a flow of fluid through said inlet to inflate said space between said sheets;

means for providing a flow of fluid to said inlet of said top;

means for providing fluid to said fluid inflatable cells.

2. The device of claim 1 wherein said upper sheet of said top comprises holes through which fluid may flow from the inflated space through said upper sheet.

3. The device of claim 1 wherein a side of said bag is formed from flexible fabric.

4. The device of claim 2 wherein said upper sheet of said top comprises a laminate of porous fabrics.

5. The device of claim 4 wherein an upper layer of said laminate comprises a porous fabric having an average pore size of less than about 0.5 microns.

6. The device of claim 1 wherein said upper sheet of said top comprises a coating containing an anti-bacterial or anti-viral compound.

7. The device of claim 1 wherein said base comprises opposing sheets of flexible fabric joined to form an envelope containing a pliant support material which is spaced from a longitudinal centerline of said base.

8. The device of claim 7 wherein said base comprises ports about along said longitudinal centerline thereof.

9. The device of claim 1 wherein one of said top or a side is removably connected to said bag.

10. The device of claim 9 wherein said top or a side is removably connected by a zipper.

11. The device of claim 1 wherein said lower sheet of said top comprises a generally fluid impermeable material.

12. The device of claim 11 wherein said generally fluid impermeable material comprises a urethane coated nylon fabric.

13. The device of claim 1 wherein said upper sheet of said top is periodically joined to said lower sheet of said top so as to form a pattern.

14. The device of claim 13 wherein said upper sheet is periodically joined to said lower sheet at spots from about 1.5 to about 2.5 inches apart.

15. The device of claim 1 wherein said fluid comprises air.

16. The device of claim 1 wherein said air cells are within said bag in transverse parallel array along the length of said bag.

17. A support blanket, adapted for placement on a bed comprising:

upper and lower sheets of flexible material arranged in opposing juxtaposition and being joined to define an area between said sheets which inflates with the flow of fluid between said sheets, the configuration of said joined sheets being suitable for the support of a patient;

an inlet to the inflation area between said sheets;

said upper sheet of material comprising a plurality of holes, sized from about 0.001 to about 0.5 microns, arranged to provide a restricted flow of fluid from said inflation area through said upper sheet;

said sheets being periodically joined, at locations within the inflation area, so as to form a pattern upon inflation, said pattern comprising a plurality of domed areas, said areas comprising a plurality of proximally arranged said holes.

18. The device of claim 17 wherein said upper sheet comprises a laminate of porous fabrics.

19. The device of claim 18 wherein an upper laminate layer of said laminate comprises a porous fabric having an average pore size of less than about 0.5 microns.

20. The device of claim 17 wherein said upper sheet comprises a coating containing an anti-bacterial or an anti-viral compound.

21. The device of claim 17 wherein said lower sheet comprises an air impermeable fabric.

22. The device of claim 17 wherein said upper sheet is periodically joined to said lower sheet at spots from about 1.5 to about 2.5 inches apart.

23. The device of claim 17 wherein said fluid comprises air.

24. The combination comprising a bed and the fluid support blanket of claim 17.

25. The combination of claim 24 wherein said bed comprises a plurality of fluid inflation cells.

26. The combination of claim 25 wherein said cells comprise air inflation cells.

27. A fluid inflation manifold adapted for the distribution of fluid from a fluid supply source to fluid inflation cells of a support device comprising:

opposing sheets of longitudinally extending flexible fabric, joined to form a plurality of longitudinally extending discrete passageways spaced from about along a longitudinal centerline of said joined fabric and having an inlet and an outlet;

means, within a discrete passageway, for supporting said discrete passageway from collapse;

wherein said outlet comprises means for connecting a passageway to a fluid inflation cell.

28. The manifold of claim 27 wherein said opposing sheets of fabric comprise a urethane coated nylon fabric.

29. The manifold of claim 27 wherein said means for supporting a discrete passageway comprises a longitudinally extending spiral element.

30. The manifold of claim 27 wherein a discrete passageway comprises three outlets.

31. The manifold of claim 27 wherein said means for connecting said passageway comprises a first mating member which engages a second mating member which comprises an inlet of said cell, to form a leak resistant connection for the flow of air between said passageway and said cell.

32. The manifold of claim 31 wherein said first mating member comprises opposing rings, which engage each other and opposite surfaces of a sheet of fabric to define a circular port through said fabric.

33. The manifold of claim 32 wherein said first mating member comprises a locking bar which crosses the circular port.

34. The manifold of claim 32 wherein said first mating member comprises a hollow, cylindrical extension which is sized to insert into and lockingly engage a mating port of a fluid support cell.

35. A fluid support cell, formed from a flexible fabric and having an inlet adapted for the flow of fluid from a fluid distribution member, said inlet comprising a first mating member constituting opposing rings, which engage each other and opposite surfaces of said fabric to define a circular port through said fabric, said first mating member comprising a locking bar which crosses said circular port.

36. The support cell of claim 35 wherein an outlet of said fluid distribution member has a second mating member comprising a hollow, cylindrical extension, which is sized to insert into said circular port defined by said first mating member, and has spaced longitudinally extending slots which lockingly engage said locking bar of said first mating member to connect said support cell to said fluid distribution member.

37. The support cell of claim 36 wherein an outlet of said fluid distribution member comprises said first mating member and an inlet of said support cell comprises said second mating member.

38. A coupling device, for joining first and second adjacent elements in fluid connection, comprising:

a first mating member comprising opposing first and second rings arranged to engage opposite surfaces of a wall of said first adjacent element arranged therebetween and define a circular port therein;

said first ring comprising a cylindrical shoulder, arranged about said circular port and defining a cylindrical passageway through said circular port and having a bar crossing said passageway;

said second ring having a circular port opening sized to receive the cylindrical shoulder of said first ring;

a second mating member comprising opposing rings arranged to engage opposite surfaces of a wall of a second adjacent element arranged therebetween and define a circular port therein;

an opposing ring of said second mating member comprising first and second cylindrical shoulders, arranged about said circular port and defining a cylindrical passageway through said circular port, said first shoulder being sized to insert into said cylindrical passageway of said first ring of said first mating member and being slotted to receive said bar; and, another of said opposing rings of said second mating member having a circular port opening sized to receive said second cylindrical shoulder of said an opposing ring.

39. The coupling device of claim 38 further comprising sealing means, mounted to seal said cylindrical passageway of said first opposing ring of said first mating member to said first cylindrical shoulder of said an opposing ring of said second mating member.

40. The coupling device of claim 39 wherein said sealing means comprises an elastomeric ring.

41. The coupling device of claim 38 wherein said first cylindrical shoulder of said second mating member is slotted in a first longitudinal direction to receive said bar and thereafter in another direction.

42. A portable distribution control device comprising:

a housing;

air pumping means, comprising an air inlet and an air outlet;

means for distributing air, pumped by said air pumping means, to a plurality of discrete passageways, said means comprising a port select valve member wherein a stream of air from said air pumping means is selectively directed through various select pluralities of spaced ports of various size openings;

wherein the selective directing of said stream of air is activated through programed computer means.

43. The device of claim 42 wherein said air pumping means comprises a variable air flow pump.

44. The device of claim 42 wherein said port select valve member comprises a rotatable member, having a plurality of spaced ports of various size openings, mounted within a valve housing comprising outlets to a plurality of discrete passageways such that ports of the rotatable member align with various outlets of the housing at various positions of rotation of the rotatable member.

45. An air support device comprising:

an air cell support bag having a base, a top and sides, said bag being configured to hold a plurality of air inflatable cells and said top of said bag comprising an upper and a lower sheet of flexible material arranged in opposing juxtaposition and having an air inlet to a space therebetween, said upper sheet of material comprises holes through which air may flow from said space therebetween;

a plurality of air inflatable cells, arranged within said bag along the length of said bag and having inlets arranged about a longitudinal centerline of said base;

an air inflation manifold comprising opposing sheets of flexible material joined to form a plurality of discrete passageways arranged about along the longitudinal centerline of said base and having outlets connected to the inlets of said air inflatable cells;

air pumping means;

air distribution means comprising a port select element arranged such that a stream of air from said air pumping means is selectively directed through various select pluralities of spaced ports of various size openings to said discrete passageways of said manifold;

means for distributing air from said air pumping means to said air inlet of said top of said bag.

46. The air support device of claim 45 wherein the selective directing of said stream of air is activated through programed microprocessor means.

47. The air support device of claim 45 wherein said port select element comprises a port for directing air to said air inlet of said top of said bag.

48. The combination of an air support device of claim 45 and a bed frame.

49. In an air inflation cell, adapted for placement on a bed frame for the support of a patient reclining thereon and comprising first and second sets of vertically disposed opposing flexible side walls arranged between a top and bottom of said cell to form a defined, generally polyhedronal inflation area for the flow of air from an inlet, the improvement comprising providing support baffles, arranged in spaced, generally horizontal facing opposition within said defined air inflation area and extending between and engaging, in air flow obstructing arrangement, said first set of opposing flexible walls in defined spaced geometric relationship upon inflation of said inflation area, said baffles defining sub-areas within said air cell and having ends arranged adjacent said second set of opposing walls which define an opening for the flow of air among said sub-areas.

50. The improved air cell of claim 49 wherein said baffle is formed from a flexible material.

51. The improved air cell of claim 49 comprising two support baffles.

* * * * *